US005369287A

United States Patent [19]

Sunaga et al.

[11] Patent Number: 5,369,287

[45] Date of Patent: Nov. 29, 1994

[54] REFRIGERATOR OIL COMPOSITION CONTAINING PHENOLIC ANTIOXIDANT AMINE AND PHOSPHORIC TRIESTER COMPONENTS

[75] Inventors: Takashi Sunaga, Ora; Takeo Komatsubara, Kiryu, both of Japan

[73] Assignee: Sanyo Electric Co., Ltd., Osaka, Japan

[21] Appl. No.: 945,656

[22] PCT Filed: Apr. 20, 1992

[86] PCT No.: PCT/JP92/00504

§ 371 Date: Nov. 13, 1992

§ 102(e) Date: Nov. 13, 1992

[87] PCT Pub. No.: WO92/19704

PCT Pub. Date: Nov. 12, 1992

[30] Foreign Application Priority Data

May 7, 1991 [JP] Japan ..... 3-101521

[51] Int. Cl.[5] ..... C10M 169/04

[52] U.S. Cl. ..... 252/50; 252/56 R; 252/68; 252/56 S

[58] Field of Search ..... 252/52 A, 56 S, 68, 252/56 R, 50

[56] References Cited

U.S. PATENT DOCUMENTS

| | | | |
|---|---|---|---|
| 4,248,726 | 2/1981 | Uchinuma et al. | 252/52 A |
| 4,454,052 | 6/1984 | Shoji et al. | 252/68 |
| 4,851,144 | 7/1989 | McGraw et al. | 252/52 A |
| 5,021,179 | 6/1991 | Zehler et al. | 252/56 S |
| 5,049,292 | 9/1991 | Grasshoff et al. | 252/68 |
| 5,096,606 | 3/1992 | Hagihara et al. | 252/68 |
| 5,202,044 | 4/1993 | Hagihara et al. | 252/68 |
| 5,279,752 | 1/1994 | Hasegawa et al. | 252/68 |

FOREIGN PATENT DOCUMENTS

| | | |
|---|---|---|
| 1-271491 | 10/1989 | Japan . |
| 2-102296 | 4/1990 | Japan . |
| 2-140296 | 5/1990 | Japan . |
| 2-140297 | 5/1990 | Japan . |
| 2-140298 | 5/1990 | Japan . |
| 2-281098 | 11/1990 | Japan . |
| 2-2786894 | 11/1990 | Japan . |
| 3-88892 | 4/1991 | Japan . |

*Primary Examiner*—Prince Willis, Jr.
*Assistant Examiner*—J. Silbermann
*Attorney, Agent, or Firm*—Wenderoth, Lind & Ponack

[57] ABSTRACT

1,1,1,2-Tetrafluoroethane is used in a refrigerator as the refrigerant, while a polyolester oil which is well compatible with the refrigerant is used as the base oil and a phenolic antioxidant, a specified amine and a phosphoric triester are added thereto to give a refrigerator oil composition. Thus the hydrolysis of the polyolester oil can be prevented to thereby protect the sliding members such as a roller and a vane from the corrosion and wear which are caused by the hydrolysis.

1 Claim, 1 Drawing Sheet

REFRIGERATOR OIL COMPOSITION CONTAINING PHENOLIC ANTIOXIDANT AMINE AND PHOSPHORIC TRIESTER COMPONENTS

TECHNICAL FIELD

The present invention relates to a refrigerator oil composition which is well compatible with 1,1,1,2-tetrafluoroethane (hereinafter referred to "R134a") used in a refrigerator as a refrigerant.

BACKGROUND OF THE INVENTION

A majority of compressors for refrigerators, vending machines and showcases have heretofore used dichlorodifluromethane (hereinafter referred to as "R12") as a refrigerant. This R12 is subject to fluorocarbon regulation because of the environmental problem of destruction of an ozone layer, and R134a is being studied as a substituent refrigerant for R12 as disclosed in, for example, Japanese Patent Publication (unexamined) No. 1-271491/1989.

However, the refrigerant R134a does not have good compatibility with a currently used refrigerating machine oil such as a mineral oil and an alkyl benzene oil. This inferior compatibility leads to the problem that imperfect lubrication of a compressor is caused by an insufficient return of the oil to the compressor or by the suction of a refrigerant which is separated from the oil when the compressor is cold started.

Under these circumstances, the inventors of the present invention made studies on polyolester refrigerator oils which are well compatible with R134a refrigerant. However, the use of a polyolester oil in a rotary compressor causes some problems. For example, the fatty acid formed by the thermal hydrolysis of the oil corrodes the sliding members and the corroded sliding members are worn away. Further, the powder formed by the wear exerts an adverse effect on organic materials of the compressor such as magnet wires of the electric motor element to impair the endurance of the compressor.

The inventors of the present invention have made various studies to use a combination of R134a refrigerant with a polyolester refrigerator oil in a rotary compressor and have found that a polyolester oil used in a rotary compressor for lubricating the sliding members can be protected from the hydrolysis caused by the frictional heat buildup of the sliding members can be protected from the hydrolysis caused by the frictional heat buildup of the sliding members by the addition of specific additives to thereby restrain the corrosion of the sliding membes which is caused by the fatty acid generated by the hydrolysis. The present invention has been accomplished on the basis of this finding.

SUMMARY OF THE INVENTION

An object of the present invention is to solve the above-described problems, and is intended to provide a refrigerator oil which can reduce frictional heat generated at sliding members and restrain hydrolysis of a polyolester oil due to the frictional heat if the polyolester oil, which has compatibility with the refrigerant R134a, is used as the refrigerator oil.

The present invention relates to a refrigerator oil composition compatible with R134a refrigerant, which is prepared by adding 0.01 to 0.30% by weight of a phenolic antioxidant, 0.01 to 0.30% by weight of an amine having a melting point of −15° C. or below and a boiling point of 100° C. or above, and 0.10 to 1.0% by weight of a phosphoric triester to a polyolester base oil composed of a polyhydric alcohol and a fatty acid.

In the present invention, the thermal hydrolysis of a polyolester oil which is well compatible with R134a and used as a refrigerant is restrained by the addition of the above-mentioned additives to thereby protect the polyolester oil from thermal decomposition.

BEST MODE FOR CARRYING OUT THE INVENTION

A preferred embodiment of the present invention will be described with reference to the accompanying drawings.

Figure 1:
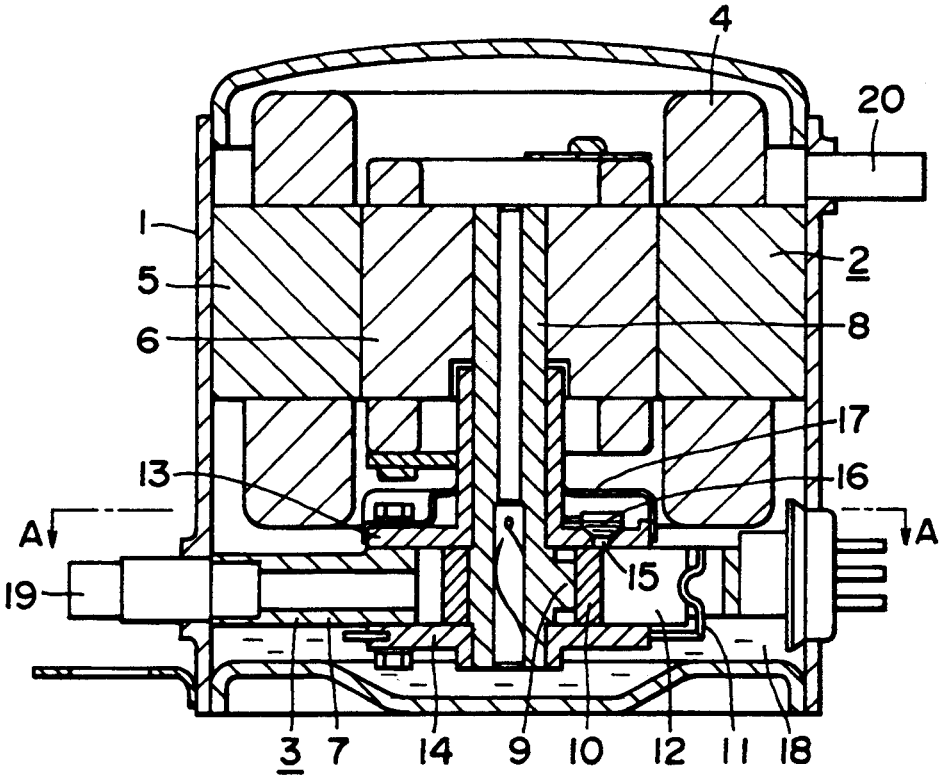
FIG. 1 is a vertical sectional view of a rotary compressor, as an example, using the refrigerator oil according to the present invention.
Figure 2:
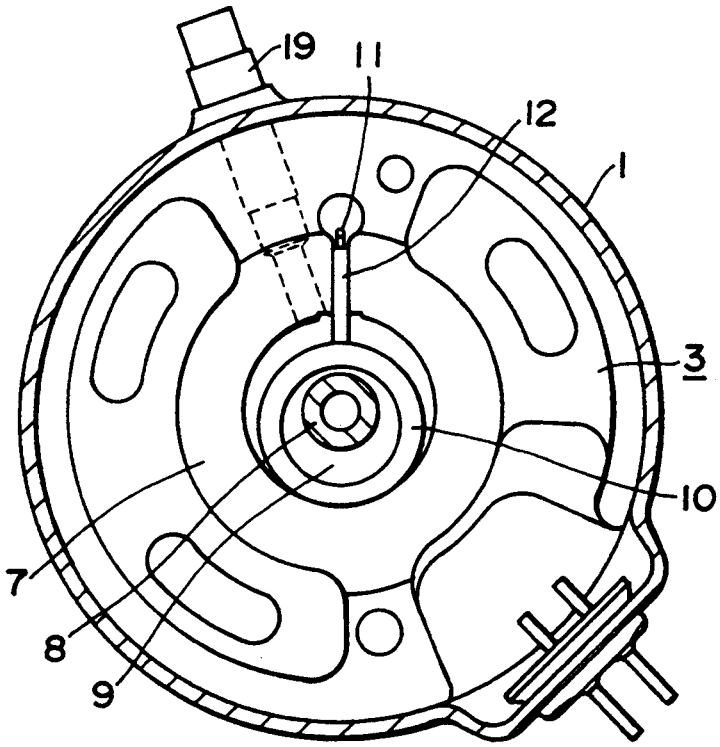
FIG. 2 is a cross sectional view of the rotary compressor.

FIG. 1 is a vertical sectional view of a rotary compressor. FIG. 2 is a sectional view of the rotary compressor, taken along line A—A of FIG. 1. In FIGS. 1 and 2, an electric motor element 2 is housed in an upper side of the sealed container 1, while a rotary compression element 3 which is driven by the power element 2 is housed in a lower side of the sealed container 1. The electric motor element 2 is made up of a stator 5 having a coil winding 4 electrically insulated by an organic material and a rotor 6 provided inside of the stator 5.

The rotary compression element 3 is made up of a cylinder 7, a roller 10 which is rotated along the inner wall of the cylinder 7 by an eccentric portion 9 of a rotary shaft 8, a vane 12 which is pressed by a spring 11 and a high-pressure refrigerant discharged into the sealed container 1 in such a manner as to be pressed against the peripheral face of the roller 10 to partition the interior of the cylinder 7 into an intake side and a discharge side, and upper and lower bearings 13 and 14 for sealing the corresponding apertures of the cylinder 7 and for rotatably supporting the rotary shaft 8.

The upper bearing 13 has a discharge hole 15 which communicates with the discharge side of the cylinder 7. The upper bearing 13 also has a discharge valve 16 for opening/closing the discharge hole 15 and a discharge muffler 17 which is mounted to cover the discharge valve 16.

The roller 10 and the vane 12 are made of an iron material.

A polyolester oil 18 composed of a polyhydric alcohol and a fatty acid is stored on the bottom of the sealed container 1. This oil contains 0.01 to 0.30% by weight of a phenolic antioxidant, 0.01 to 0.30% by weight of an amine having a melting point of −15° C. or below and a boiling point of 100° C. or above, and 0.10 to 1.0% by weight of a phosphoric triester.

The phenolic antioxidant is selected from the group consisting of 2,6-di-t-butyl-p-cresol, 2,6-di-t-butylphenol, 2,4,6-tri-t-butylphenol and so forth. When the amount of the phenolic antioxidant to be used is less than 0.01% by weight, the total acid value of the resulting oil composition will be too high, while when it exceeds 0.30% by weight, the oil will be degraded.

The amine is selected from the group including amylamine, hexylamine, heptylamine, dipropylamine, tripropylamine, trinonylamine, dibenzylamine. When the amount of the amine to be used is less than 0.01% by weight, the phosphoric triester will be degraded and the hydrolysis of the oil cannot be restrained, while when it exceeds 0.30% by weight, the sludging and degradation of the oil will be accelerated unfavorabaly.

The phosphoric triester is selected from the group consisting of triphenyl phosphate, tricresyl phosphate, tri-t-butylphenyl phosphate, triproply phosphate, tributyl phosphate, tribenzyl phosphate, trihexyl phosphate, trioctyl phosphate, tridecyl phosphate and so forth. These triesters may be used either alone or as a mixture of two or more of them. When the amount of the phosphoric triester to be used is less than 0.10% by weight, the lubricity of the resulting oil composition will be poor, while when it exceeds 1.0% by weight, the sludging and degradation of the oil will be accelerated unfavorably.

According to the present invention, three additives, i.e., a phenolic antioxidant, a specified amine and a phosphoric triester are simultaneously used each in suitable amounts, by which the degradation of the oil can be restrained and the wear resistance of the sliding members can be improved.

The oil 18 lubricates the sliding surfaces of the roller 10 and the vane 12 which are the sliding members of the rotary compression element 3.

The refrigerant which flows into the cylinder 7 of the rotary compression element 3 and is compressed by the cooperation of the roller 10 and the vane 12 is R134a which is well compatible with the polyolester oil 18.

A suction pipe 19 is set on the hermetically sealed container 1 and this suction pipe 19 leads the refrigerant to the suction side of the cylinder 7. A discharge pipe 20 is set on the upper wall of the sealed container 1 and the refrigerant compressed by the rotary compression element 3 is discharged from the sealed container 1 throught the pipe 20.

In the rotary compressor described above, R134a flows into the suction side of the cylinder 7 though the suction pipe 19 and is compressed by the cooperation of the roller 10 and the vane 12. The discharge valve 16 is opened and the compressed refrigerant is ejected into the discharge muffler 17 through the discharge hole 15. The refrigerant is further passed thought the electric motor element 2 and ejected from the sealed container 1 through the discharge pipe 20. On the other hand, the oil 18 is fed onto the sliding surfaces of the sliding members (such as the roller 10 and the vane 12) of the rotary compression element 3 and lubricate the sliding membes, by which the refrigerant compressed in the cylinder 7 is prevented from leaking to the lower pressure side through a slit between the sliding surfaces.

EXAMPLE AND COMPARATIVE EXAMPLES

Figure 3:
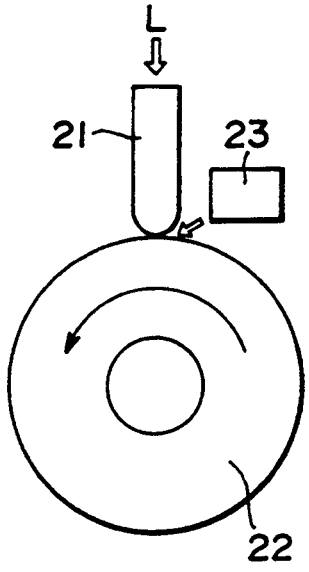
FIG. 3 is a plan view of an Amsler testing machine.

The performances of the oil composition were evaluated by the use of an Amsler's abrasion testing machine as shown in FIG. 3. The results are given in Table 1.

TABLE1

| | Base oil | Addtitves | Total acid value of polyol ester oil after test (mgKOH/g) | Wearing of test pieces: max. wear width of stationary piece (mm) | Wearing of test pieces: dimensional change of rotary piece (outer diameter, μm) | Wearing of test pieces: surface roughness of rotary piece |
|---|---|---|---|---|---|---|
| Ex. | polyol ester oil | tricresyl phosphate 0.30 wt. % heptylamine 0.10 wt. % 2,6-di-t-butyl-p-cresol 00.5 wt. % | 0.01 | 0.25 | −2 | 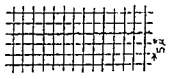 |
| Comp. Ex. 1 | polyol ester oil | tricresyl phosphate 0.30 wt. % 2,6-di-t-butyl-p-cresol 00.5 wt. % | 0.10 | 0.78 | −8 | 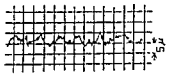 |
| Comp. Ex. 2 | polyol ester oil | 2,6-di-t-butyl-p-cresol 00.5 wt. % | 0.09 | 1.00 | −10 | 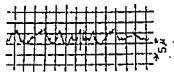 |
| Comp. Ex. 3 | polyol ester oil | 2,6-di-t-butyl-p-cresol 00.5 wt. % heptylamine 0.10 wt. % | 0.04 | 0.98 | −5 | 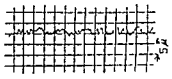 |

A stationary piece 21 corresponding to the vane has a curved tip and sustains a load L. A rotary piece 22 corresponding to the roller is rotated for 20 hours, while feeding an oil 23 prepared by adding 0.05% by weight of 2,6-di-t-butyl-p-cresol, 0.1% by weight of heptyl-amine and 0.3% by weight of tricresyl phosphate to a polyol ester base oil to a part wherein the rotary piece 22 is pressed against the stationary piece 21. It can be understood from the results given in Table 1 that the wear resistance is excellent when the polyolester oil containing the additives according to the present invention is fed onto the sliding surfaces of the stationary piece 21 and the rotary piece 22, which is thought to be presumably because the hydrolysis of the polyolester oil caused by the frictional heat buildup of the sliding surfaces of the rotary piece 22 and the stationary piece 21 is restrained by the synergistic effect of a combination of the three additives, i.e., a phenolic antioxidant, a specified amine and a phosphoric triester, to thereby prevent the corrosion of the pieces which is caused by the fatty acid generated by the hydrolysis of the oil.

When the polyolester oil does not contain any amine, the phosphoric triester will be degraded to result in poor lubricity (see Comparative Example 1). When the oil contains, neither phosphoric triester nor any amine, the resulting oil composition will exhibit poor lubricity and cannot be prevented from undergoing hydrolysis (see Comparative Example 2). Further, when the oil does not contain any phosphoric triester, the lubricity thereof will be poor (see Comparative Example 3). As described above, in the present invention the hydrolysis of a polyolester oil which is composed of a polyhydric alcohol and a fatty acid and is well compatible with R134a used as a refrigerant in a refrigerator is restrained by adding 0.01 to 0.03% by weight of a phenolic alcohol, 0.01 to 0.30% by weight of an amine having a melting point of −15° C. or below and a boiling point of 100° C. or above, and 0.10 to 1.0% by weight of a phosphoric triester to the oil, by which the wear resistance of the sliding members of the compressor is improved.

What is claimed is:

1. A refrigerator oil composition which is compatible with 1,1,1,2-tetrafluoroethane used as the refrigerant, wherein said oil composition consists essentially of (a) 0.01 to 0.30% by weight of a phenolic antioxidant, (b) 0.01 to 0.30% by weight of an amine selected from the group consisting of amylamine, hexylamine, heptylamine, dipropylamine, tripropylamine, trinonylamine, and dibenzylamine having a melting point of −15° C. or below and a boiling point of 100° C. or above, (c) 0.10 to 1.0% by weight of a tricresyl phosphate, and (d) a polyolester base oil composed of a polyhydric alcohol and a fatty acid.

* * * * *